US005465777A

United States Patent [19]

Brunner

[11] Patent Number: 5,465,777

[45] Date of Patent: Nov. 14, 1995

[54] CONTACT POURING

[75] Inventor: Donald G. Brunner, North Fort Myers, Fla.

[73] Assignee: The Budd Company, Troy, Mich.

[21] Appl. No.: 245,705

[22] Filed: May 18, 1994

[51] Int. Cl.[6] ..... B22D 41/00; B22D 41/16; B22D 43/00

[52] U.S. Cl. ..... 164/136; 164/337; 164/158

[58] Field of Search ..... 164/136, 133, 164/121, 158, 337, 335

[56] References Cited

U.S. PATENT DOCUMENTS

| | | |
|---|---|---|
| 470,525 | 3/1892 | Weiss . |
| 807,072 | 12/1905 | Grimes et al. . |
| 936,486 | 10/1909 | Christianson . |
| 1,013,548 | 1/1912 | Grey . |
| 1,065,301 | 6/1913 | Dutton . |
| 1,121,455 | 12/1914 | Bate . |
| 1,477,204 | 12/1923 | Bisey . |
| 1,833,663 | 11/1931 | Tikalsky . |
| 1,939,831 | 12/1933 | Scheible . |
| 2,018,586 | 10/1935 | Wetherill, Jr. et al. . |
| 2,210,544 | 8/1940 | Galloway . |
| 2,674,640 | 4/1954 | Tama . |
| 2,912,728 | 11/1959 | Sylvester . |
| 3,032,841 | 5/1962 | Sylvester . |
| 3,058,180 | 10/1962 | Port, Jr. et al. . |
| 3,114,947 | 12/1963 | Sylvester . |
| 3,162,909 | 12/1964 | Sylvester . |
| 3,163,897 | 1/1965 | Sylvester . |
| 3,201,837 | 8/1965 | Sylvester . |
| 3,321,116 | 5/1967 | Loftin . |
| 3,452,805 | 7/1969 | Morin . |
| 3,459,254 | 8/1969 | Dearth . |
| 3,504,825 | 4/1970 | Diamond et al. . |
| 3,605,861 | 9/1971 | Lohman . |
| 3,618,834 | 11/1971 | Shapland, Jr. . |
| 3,672,432 | 6/1972 | Widdowson et al. . |
| 3,727,674 | 4/1973 | Chatourel et al. . |
| 3,729,118 | 4/1973 | Wernli et al. . |
| 3,754,634 | 8/1973 | Gerbig et al. . |
| 3,771,588 | 11/1973 | Cavanagh . |
| 3,814,170 | 6/1974 | Kahn . |
| 3,844,453 | 10/1974 | Eickelberg . |
| 3,877,675 | 4/1975 | Shapland . |
| 3,892,272 | 7/1975 | Troy et al. . |
| 3,924,422 | 12/1975 | Sandor et al. . |
| 3,929,184 | 12/1975 | Reuter et al. . |
| 3,976,118 | 8/1976 | Kahn . |
| 4,008,749 | 2/1977 | Bellocci et al. . |
| 4,010,876 | 3/1977 | Steinemann . |
| 4,076,070 | 2/1978 | Lefebvre et al. . |
| 4,133,370 | 1/1979 | Bellocci et al. . |
| 4,153,100 | 5/1979 | Balevski et al. . |
| 4,431,046 | 2/1984 | Phillips . |
| 4,445,670 | 5/1984 | Hayashi . |
| 4,460,163 | 7/1984 | Hornung . |
| 4,580,616 | 4/1986 | Watts . |
| 4,589,466 | 5/1986 | Chandley et al. . |
| 4,593,741 | 6/1986 | Caugherty . |
| 4,595,044 | 6/1986 | Caugherty et al. . |
| 4,616,689 | 10/1986 | Denis . |
| 4,671,342 | 6/1987 | Balevski et al. . |
| 4,693,292 | 9/1987 | Campbell . |
| 4,730,755 | 3/1988 | Hayashi . |
| 4,733,714 | 3/1988 | Smith . |

OTHER PUBLICATIONS

*Pam Presents Its New "FM" Process for Casting of Thin-Wall Iron or Steel Parts*, 22 pages.

Henych et al., The Development Trends in the Ductile Iron Metallurgy, 17 pages.

*Primary Examiner*—Kuang Y. Lin

*Attorney, Agent, or Firm*—Harness, Dickey & Pierce

[57] ABSTRACT

Disclosed is a contact pouring vessel and method for pouring molten metal directly into a mold. A pouring vessel holds the molten metal in a molten state. A nozzle within the pouring vessel and having an orifice enables the molten metal to pour from the pouring vessel. A stopper rod is raised or lowered to either seal the orifice or permit the molten metal to flow out the pouring vessel. A rotating cutter cleans the bottom of the nozzle each time a mold is filled to prohibit an unwanted buildup on the nozzle. Four hydraulic cylinders and a hydraulic system are used to controllably raise and lower the pouring vessel. The pouring vessel is raised to accommodate the positioning of mold adjacent the nozzle and lowered to position the nozzle flush with the mold.

23 Claims, 3 Drawing Sheets

CONTACT POURING

BACKGROUND OF THE INVENTION

1. Field of the Invention

This invention relates generally to the pouring of molten metals from a vessel and, more particularly, to contact pouring wherein the vessel is brought in contact with a mold for pouring.

2. Discussion of the Related Art

Devices for pouring molten metals are generally known in the art. Historically, the pouring of gray, malleable and ductile iron into sand molds was done by hand using a pouring ladle. Today, hand pouring has been in part substantially replaced by the use of pressure pouring vessels. These pressure pouring vessels are typically equipped with a stopper rod which enables the molten metal to pour out an orifice in a nozzle when the stopper rod is raised and pressure is applied within the vessel.

In the typical pressure pouring vessel, it is desirable to reduce the velocity of the molten metal as the molten metal enters the mold, which is known in the art as metal impingement velocity. To achieve this, the stopper rod in the pouring vessel is positioned as close to the top of the mold as possible. However, this distance must be sufficient enough to allow for the next mold in line to be moved into place easily. In addition, when the last molten metal exits the nozzle as the stopper rod is closed, the exiting molten metal tends to freeze and buildup on the nozzle. This buildup thus requires an additional clearance between the pouring vessel and the mold to enable the nozzle to be manually cleaned, while the entire pouring operation is stopped. Moreover, as the molten metal exits the pressure pouring vessel, the molten metal freely travels through the atmosphere before eventually entering the mold which causes unwanted oxidation of the metal. Thus, the greater the distance between the pouring vessel and the mold the greater the oxidation.

After the molten metal exits the pressure pouring vessel, it is generally directed into a pouring basin which is cut atop the mold. The pouring basin serves no purpose other than to act as an open end of a funnel to facilitate the pouring of all the metal into the mold. This pouring basin is fitted or connected to a sprue or canal which directs the molten metal into a casting cavity within the mold. The sprue is typically tapered to control the flow of the molten metal into the mold. Since the casting cavity is generally filled from the bottom, the height difference between the molten metal level in the casting cavity and the top of the molten metal in the pouring basin determines the rate at which the mold is filled. Consequently, the pouring operation must be initially fast in order to fill the sprue and the pouring basin. Thereafter, the pouring operation must be progressively slowed down to match the mold fill rate so as to not pour molten metal out or atop the mold.

The closer the casting cavity is located to the top of the mold, the more difficult it becomes to fill the remaining portion of the mold and the greater the tendency for metal shrinkage defects to occur in this portion of the casting. Moreover, since the casting yield of a mold is defined by the casting weight divided by the total mold pour weight, it is apparent that if the pouring basin can be eliminated altogether, the casting yield can be significantly increased.

Use of the above-mentioned pressure pouring vessel transfers molten metal from a vessel into a mold. However, this apparatus and method has several disadvantages associated with its use. These disadvantages include unwanted oxidation of the metal, the stopping of pouring operations to manually clean clogged nozzles, difficult flow rate control, reduced flow rate, increased metal shrinking defects and reduced casting yield.

What is needed then is a contact pouring vessel and method for pouring molten metal directly into a mold without the need for a pouring basin, and without the unwanted nozzle buildup. This will, in turn, eliminate the unwanted oxidation of the metal, eliminate the need for shutting down pouring operations in order to manually clean clogged nozzles, eliminate the difficult flow rate control while at the same time increasing flow rates, reduce metal shrinkage defects and increase casting yield. It is, therefore, an object of the present invention to provide such a contact pouring vessel.

SUMMARY OF THE INVENTION

In accordance with the teachings of the present invention, a contact pouring vessel and method for pouring molten metal directly into a mold is disclosed. This is basically achieved by elevating a pouring vessel which contains the molten metal. Positioning the mold under a nozzle within the pouring vessel. Lowering the pouring vessel so that the nozzle is flush with the mold. Filling the mold with the molten metal and again raising the pouring vessel. Thereafter, automatically cleaning the nozzle with a rotating cutter.

In one preferred embodiment, a pouring vessel is provided for holding the molten metal in a molten state. A nozzle is contained exterior to the pouring vessel and has an orifice through which the molten metal can flow. A stopper rod is used to seal the orifice in the nozzle to prevent the molten metal from exiting the pouring vessel until the stopper rod is raised. A rotating cutter is used to clean the nozzle each time a mold is filled, thereby preventing an unwanted buildup on the nozzle. Four hydraulic cylinders and a hydraulic system are used to raise and lower the pouring vessel. The pouring vessel is raised to accommodate the positioning of the mold adjacent the nozzle, while the pouring vessel is lowered to position the nozzle flush with the top of the mold.

Use of the present invention provides a contact pouring vessel and method for directly pouring molten metal into a mold. As a result, the aforementioned disadvantages associated with current pressure pouring vessels have been substantially eliminated.

BRIEF DESCRIPTION OF THE DRAWINGS

Still other advantages of the present invention will become apparent to those skilled in the art after reading the following specification and by reference to the following drawings in which.

DETAILED DESCRIPTION OF THE PREFERRED EMBODIMENT

The following description of a contact pouring vessel for pouring molten metal directly into a mold is merely exemplary in nature and is in no way intended to limit the invention or its applications or uses.

Figure 1A:
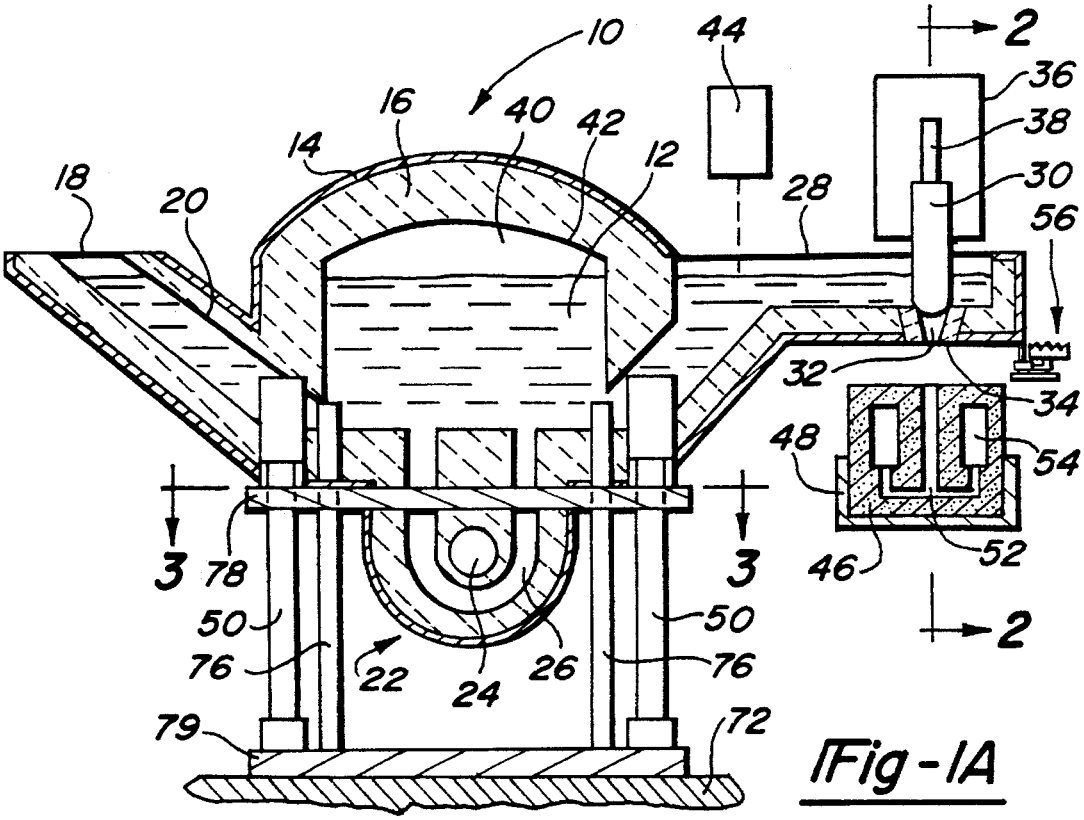
FIG. 1A is a partial cross-sectional view of one preferred embodiment of the present invention in a fully elevated position.

Referring to FIG. 1A, a cross-sectional view of one preferred embodiment of a contact pouring vessel 10, is shown in its fully elevated position. The contact pouring vessel 10 contains molten metal 12 which is contained within an outer metal housing skin 14 and a thick refractory layer 16. The molten metal 12 enters the contact pouring vessel 10 through a fill spout 18 located adjacent to a fill chamber 20.

The molten metal 12 is kept heated and molten by an induction furnace 22 located at the lower portion of the contact pouring vessel 10. The induction furnace 22 includes a coil assembly 24 which essentially performs the heating function of the induction furnace 22 as the molten metal 12 flows around a molten metal loop 26.

The contact pouring vessel 10 is equipped with a pouring launder 28 which is fitted with a stopper rod 30. The stopper rod 30 is snugly seated within an orifice 32 of a nozzle 34 to prevent the molten metal 12 from exiting the pouring launder 28 until the stopper rod 30 is raised. The stopper rod 30 is raised or lowered approximately two (2) inches via a lift mechanism 36 which is preferable a hydraulic cylinder 38.

The molten metal 12 is evacuated from the contact pouring vessel 10 into the pouring launder 28 by means of applying pressure 40 atop the molten metal bath 12 in an intermediate chamber 42. The level of the molten metal 12 in the pouring launder 28 is maintained constant by a level sensing system 44 as the pressure 40 is applied to the intermediate chamber 42. The level sensing system 44 is preferably a Selcom Model 2005-554 reflective laser system which utilizes lasers (not shown) as a measuring mechanism.

Figure 1B:
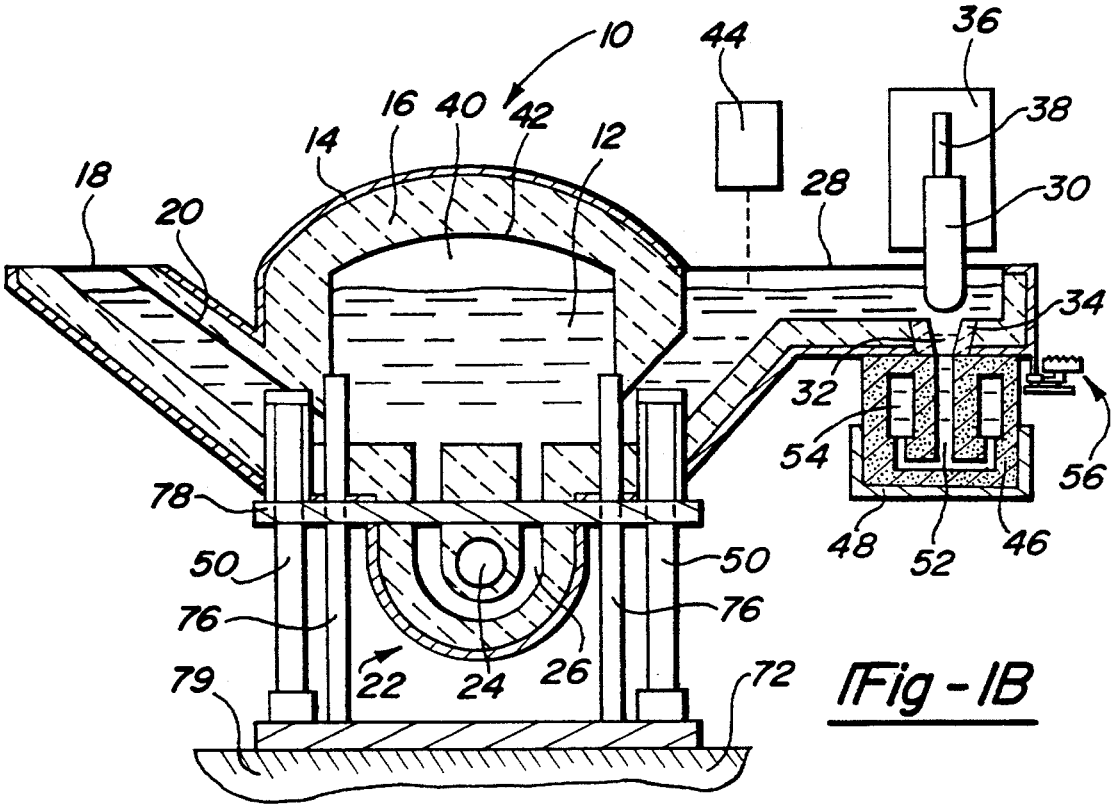
FIG. 1B is a partial cross-sectional view of the embodiment in FIG. 1A in a fully lowered position.

Referring to FIG. 1B, after a mold 46 is indexed into place under the pouring nozzle 34 by means of a mold line or conveyer belt 48, the contact pouring vessel 10 is quickly lowered approximately four inches by means of four (4) hydraulic cylinders 50. This allows the nozzle 34 to seat firmly and flush atop the mold 46, which is preferably a sand mold 46. Thereafter, when the stopper rod 30 is raised by the lift mechanism 36, the molten metal 12 flows from the pouring launder 28 out the orifice 32 of the nozzle 34. The molten metal 12 flows into a sprue or canal 52 to fill mold cavities 54. The mold cavities 54 are filled by the molten metal 12 in the pouring launder 28 as long as the stopper rod 30 is in its up position. The longer the stopper rod 30 is left in its up position, the longer the molten metal 12 flows into the mold 46. The pour is completed in about 10 to 12 seconds and the stopper rod 30 is then lowered into nozzle 34. Thereafter, the contact pouring vessel 10 is elevated to its full up position, shown in FIG. 1A, by utilizing the hydraulic cylinders 50.

Figure 2A:
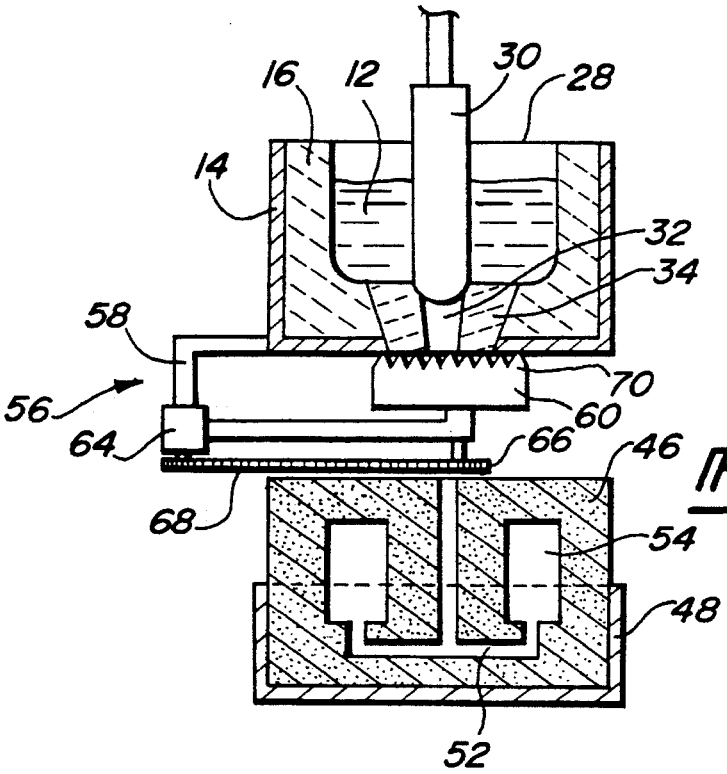
FIG. 2A is a cross-sectional side view of a nozzle cleaning device of the present invention taken along the line 2—2 of FIG. 1A.

Turning to FIG. 2A, there is shown a nozzle cleaning device 56 which is connected to the pouring launder 28 via a support arm 58. The nozzle cleaning device 56 is employed to remove and clean sand, solidified iron and slag which tends to buildup on the underside of the nozzle 34, so that the nozzle 34 will seat flush against the mold 46. If the unwanted buildup is not removed, the molten metal 12 will leak between the nozzle 34 and the mold 46, resulting in molten metal 12 flowing out and over the mold 46. If this overflow occurs, the pouring operation typically must be aborted for the mold 46, being filled.

Figure 2B:
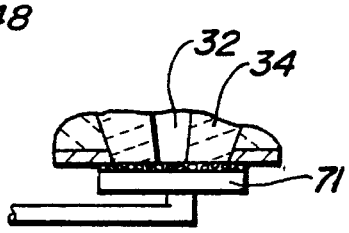
FIG. 2B is cross-sectional view of another embodiment of the nozzle cleaning device.

To insure that there is always a good seal between the nozzle 34 and the mold 46, a cutter 60 is utilized to remove the unwanted buildup. The cutter 60 is automatically pivoted into place under the nozzle 34 by a cutter arm 62 utilizing a hydraulic cylinder (not shown). The cutter 60 is rotated at about 120 revolutions per minute (RPM) by a hydraulic motor 64 via a sprocket 66 and a chain drive 68. The cutter 60 is preferably a standard milling cutter having carbide/high speed steel inserts for teeth 70. It should also be noted that an abrasive grinding disk 71 may be used in place of the cutter 60, shown clearly in FIG. 2B. The abrasive grinding disk 71 is about one-quarter (¼) of an inch thick having a coarse surface comprising aluminum oxide. The abrasive grinding disk 71 is rotated about 1000 RPMs. The nozzle cleaning device 56 is employed each time a mold 46 is poured to face or clean the build-up on the nozzle 34, thereby truing the relationship between the nozzle 34 and the mold 46.

Figure 3:
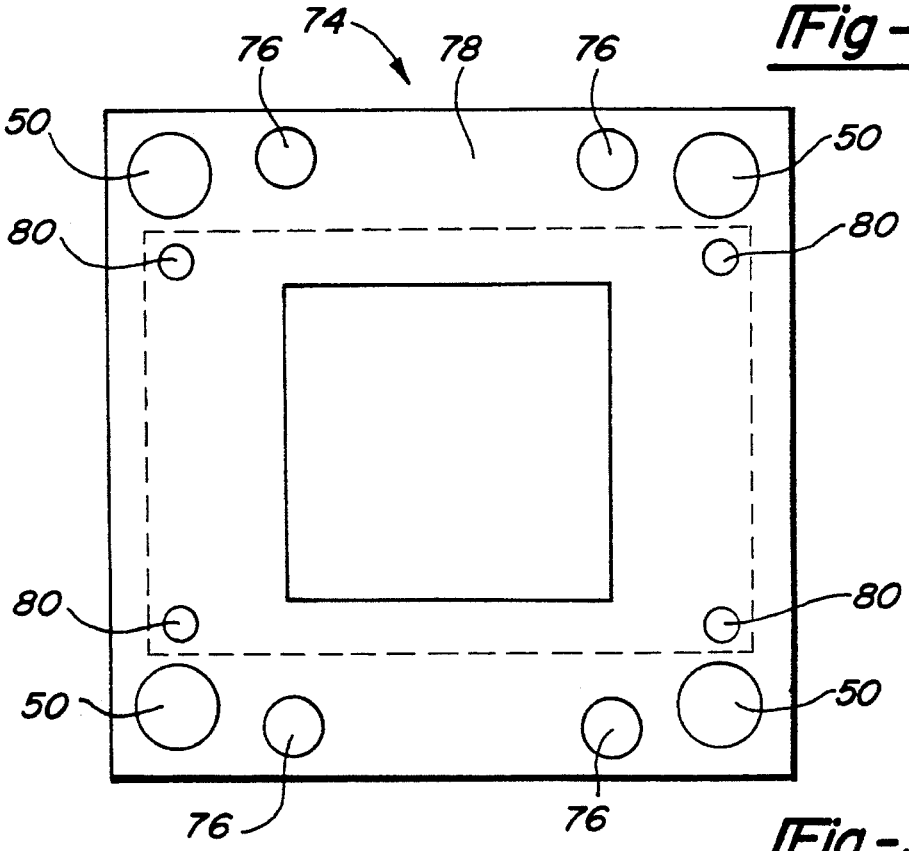
FIG. 3 is a cross-sectional view of a vessel raising and lowering system of the present invention taken along the line 3—3 of FIG. 1A.

To lift the contact pouring vessel 10 substantially perpendicular to a floor 72, a contact pouring lift system 74 is employed, shown clearly in FIG. 3. The lift system 74 utilizes the four (4) hydraulic cylinders 50 to raise and lower the contact pouring vessel 10 approximately four (4) inches to allow the positioning and indexing of multiple molds 46 beneath the nozzle 34. Four (4) vertical guide bars 76 pass through a base plate 78 to eliminate any horizontal thrust on the hydraulic cylinders 50 and to insure vertical alignment of the contact pouring vessel 10, shown clearly in FIGS. 1A and 1B. The hydraulic cylinders 50 and the vertical guide bars 76 are also mounted to a support plate 79. The contact pouring vessel 10, which typically weighs about 30,000 pounds, is raised or lowered about four (4) inches in a time span of about two (2) seconds for an average velocity of about two (2) inches per second.

Since the contact pouring vessel 10 is extremely heavy and since the pouring launder 28 is approximately five (5) feet long, the pouring launder 28 generally will flex under the heat of the molten metal 12 (i.e., 2700° F.) and the movement of the vessel 10. Thus, it becomes necessary to true the bottom of the nozzle 34 with the mold 46 to insure that the nozzle 34 is substantially parallel with the top of the mold 46. To accomplish this, the base plate 78 is fitted with four (4) ball screws 80 located at each corner of the base plate 78 and positioned under the vessel 10. Each ball screw 80 is actuated with a servo motor (not shown) to reposition the level of the contact pouring vessel 10 which maintains the bottom of the nozzle 34 parallel with the top of the mold 46. A programmable logic controller (not shown) used in conjunction with transducers (not shown) are used to sense the relationship of the nozzle 34 to the mold 46 in order to adjust the ball screws 80 accordingly over time.

Figure 4:
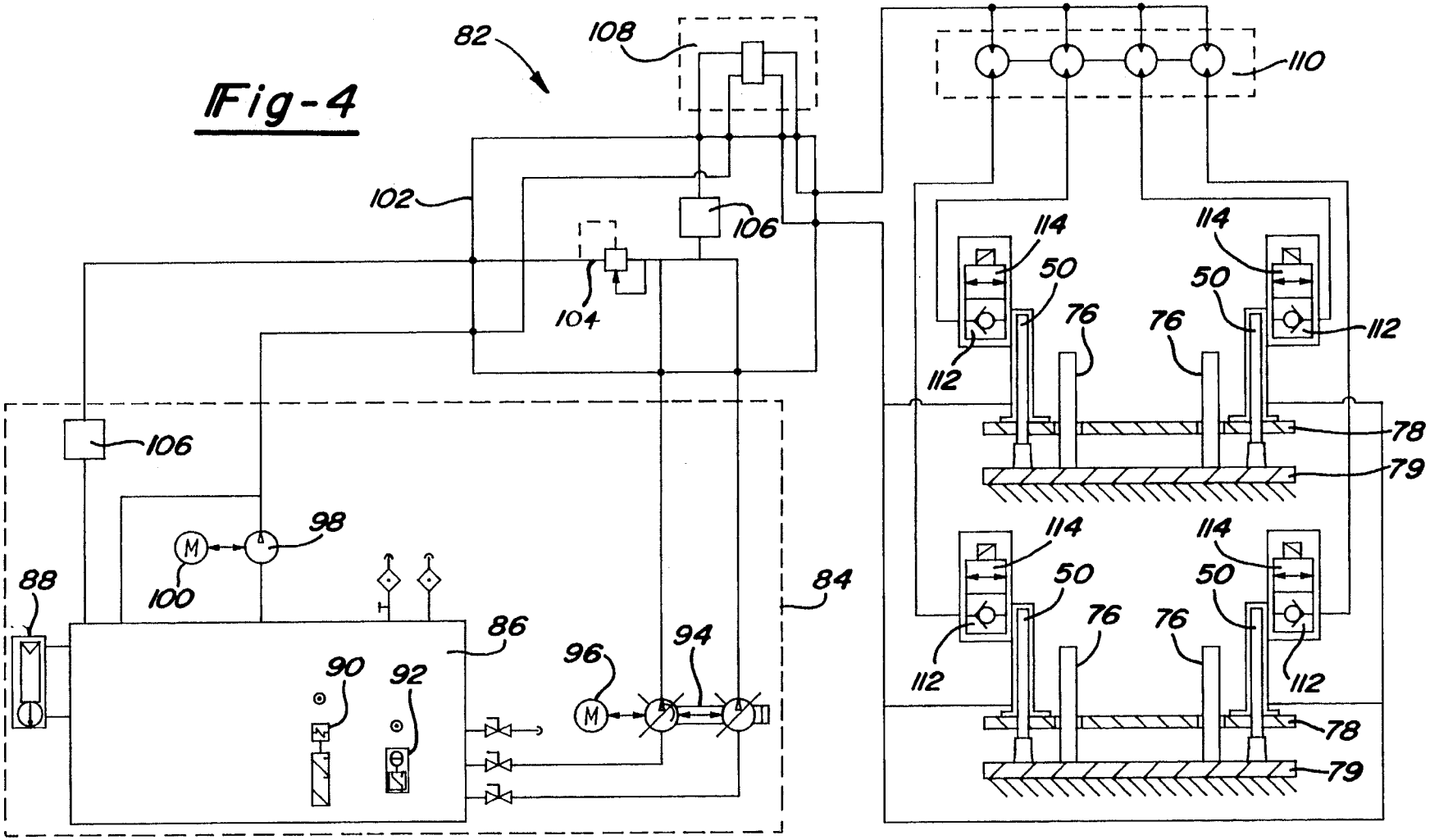
FIG. 4 is a schematic block diagram of a hydraulic system of the present invention.

Turning to FIG. 4, there is shown a schematic block diagram of a hydraulic system 82 used to control the hydraulic cylinders 50. The hydraulic system 82 includes a hydraulic power supply 84. The hydraulic power supply 84 includes a fluid reservoir 86 having a fluid meter 88, temperature controls 90 and level controls 92. The hydraulic fluid (not shown) in the reservoir 86 is pumped through a double gang pump 94 having a motor 96. An additional pump 98 and a motor 100 are also utilized to continuously filter the hydraulic fluid. The hydraulic power supply 84 is connected to the hydraulic cylinders 50 via a hydraulic manifold 102, which is essentially a connecting mechanism. A regulator valve 104 is connected to the hydraulic manifold 102 to maintain a substantially constant pressure throughout the hydraulic system 82. In addition, two filters 106 are utilized to ensure that the fluid remains clean from contaminants.

After the fluid is pumped from the double gang pumps 94, the fluid passes through the filter 106 and into a proportional control valve 108. The proportional control valve 108 is an analog valve which controls the speed of the hydraulic cylinders 50 from a ±10 volt direct current (VDC) input. The speed of the hydraulic cylinders 50 are controlled so that when the vessel 10 is lowered, it does not hit the mold 46 abruptly, thereby causing the mold to break which will result in sand filling the sprue 52 or distortion of the mold cavities 54. The fluid feeds through four flow dividers 110 which are coupled together mechanically to evenly meter the fluid into each hydraulic cylinder 50. By feeding the hydraulic cylinders 50 evenly, this ensures that the vessel 10 raises and lowers evenly to allow the nozzle 34 to seat flush with the mold 46.

The fluid then passes through check valves 112 which are activated by solenoids 114 controlled with 120 volt alternating current (VAC) signal. When the cylinders 50 are elevated, the check valves 114 are de-energized so that when the vessel 10 reaches its fully elevated position, the valves 112 check so that the vessel 10 will not lower. To lower the vessel 10, the solenoids 114 are energized to release the fluid checked by the check valves 112. The fluid is then returned evenly back through the flow dividers 110. This allows the vessel 10 to be lowered evenly, while the proportional control valve 108 controls the speed. By utilizing the proportional control valve 108 in conjunction with the flow dividers 110 and guide bars 76, the vessel 10 can be accurately controlled throughout its range of motion.

In operation, the contact pouring vessel 10 is first set in its fully elevated position, as shown clearly in FIG. 1A. A mold 46 on the conveyer belt 48 is then indexed into place beneath the nozzle 34. The contact pouring vessel 10 is then controllable lowered with the hydraulic cylinders 50 so that the nozzle 34 contacts or seats flush against the mold 46, shown clearly in FIG. 1B.

The stopper rod 30 is then raised with the lift mechanism 34 to release the molten metal 12 into the sprue 52 and the mold cavities 54. The pressure 40 ensures that there is molten metal 12 in the pouring launder 28 and assists in the release of the molten metal 12. Once the mold cavities 54 are filled, the stopper rod 30 is lowered to prohibit further release of the molten metal 12.

The pouring vessel 10 is then elevated, as shown in FIG. 1A, to allow the next mold 46 on the conveyer belt 48 to be indexed into place, in addition to allowing the nozzle 34 to be cleaned with the nozzle cleaning device 56. The nozzle cleaning device 56 removes unwanted buildup on the nozzle 34 such as sand, slag and solidified iron. The nozzle cleaning device 56 is then pivoted away from the nozzle 34 so that the pouring operation on the next mold 46 can begin.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined by the following claims.

What is claimed is:

1. A contact pouring vessel for pouring molten metal directly into a mold, said contact pouring vessel comprising:

a pouring vessel for holding the molten metal in a molten state;

a nozzle within the pouring vessel having an orifice through which the molten metal exits the pouring vessel;

flow control means for controlling the flow of the molten metal out the orifice of the nozzle and directly into the mold;

cleaning means for automatically cleaning the nozzle each time a mold is filled to prohibit an unwanted buildup on the nozzle; and elevating means for controllably raising and lowering the pouring vessel, wherein said elevating means raises the pouring vessel to accommodate the positioning of the mold adjacent the nozzle and lowers the pouring vessel to position the nozzle flush with the mold.

2. The contact pouring vessel as defined in claim 1 wherein the pouring vessel includes a heating means for heating the molten metal.

3. The contact pouring vessel as defined in claim 2 wherein the heating means is an induction furnace.

4. The contact pouring vessel as defined in claim 1 wherein the flow control means includes a stopper rod connected to a lifting means for raising and lowering the stopper rod, wherein the stopper rod is lowered to seal the orifice of the nozzle and raised to allow the molten metal to exit through the orifice of the nozzle.

5. The contact pouring vessel as defined in claim 4 wherein the lifting means is a hydraulic cylinder.

6. The contact pouring vessel as defined in claim 4 wherein the flow control means further includes pressure means for applying a pressure within the pouring vessel to push the molten metal out the orifice of the nozzle.

7. The contact pouring vessel as defined in claim 1 wherein the cleaning means includes a rotating cutter having teeth for cleaning the nozzle.

8. The contact pouring vessel as defined in claim 7 wherein the cutter is a milling cutter and the teeth are carbide/high speed steel inserts.

9. The contact pouring vessel as defined in claim 7 wherein the cutter is pivoted into position adjacent to the nozzle by utilizing a support arm.

10. The contact pouring vessel as defined in claim 9 wherein the cutter is rotated by a chain and sprocket assembly with a hydraulic motor.

11. The contact pouring vessel as defined in claim 1 wherein the cleaning means includes an abrasive grinding disk having a coarse surface for cleaning the nozzle.

12. The contact pouring vessel as defined in claim 11 wherein the abrasive grinding disk having the coarse surface is comprised of aluminum oxide.

13. The contact pouring vessel as defined in claim 1 wherein the elevating means includes a plurality of hydraulic cylinders used to raise and lower the pouring vessel.

14. The contact pouring vessel as defined in claim 1 wherein the elevating means includes a plurality of vertical guide bars to prohibit horizontal movement of the pouring vessel as the elevating means raises and lowers the pouring vessel.

15. The contact pouring vessel as defined in claim 1 wherein the elevating means includes a plurality of ball screws used for maintaining the bottom of the nozzle parallel with the top of the mold, wherein said ball screws are automatically actuated by servo motors to reposition the level of the pouring vessel in relation to the mold.

16. The contact pouring vessel as defined in claim 13 wherein the hydraulic cylinders are controlled by a hydraulic system having a proportional control valve for controlling the speed of the hydraulic cylinders.

17. The contact pouring vessel as defined in claim 16 wherein the hydraulic system further includes a plurality of flow dividers, such that each hydraulic cylinder is connected to a single flow divider, wherein said plurality of hydraulic cylinders are evenly filled with fluid as the pouring vessel is raised and evenly evacuated with fluid as the pouring vessel is lowered.

18. The contact pouring vessel as defined in claim 16 wherein the hydraulic system further includes a plurality of check valves, such that each hydraulic cylinder is connected to a single check valve, wherein said plurality of check valves check the hydraulic cylinders when the pouring vessel is raised to hold the pouring vessel in a raised position.

19. A contact pouring vessel for pouring molten metal directly into a mold, said contact pouring vessel comprising:

a pouring vessel for holding the molten metal in a molten state, said pouring vessel including heating means for heating the molten metal;

a nozzle within the pouring vessel having an orifice through which the molten metal exits the pouring vessel;

flow control means for controlling the flow of the molten metal out the orifice of the nozzle and directly into the mold, said flow control means including a stopper rod connected to a lifting means for raising and lowering the stopper rod, said stopper rod lowered to seal the orifice of the nozzle and raised to allow the molten metal to exit through the orifice of the nozzle;

cleaning means for automatically cleaning the nozzle each time a mold is filled to prohibit an unwanted buildup on the nozzle, said cleaning means including a rotating cutter having teeth for cleaning the nozzle; and elevating means for controllably raising and lowering the pouring vessel, said elevating means including a plurality of hydraulic cylinders controlled by a hydraulic system, wherein said hydraulic cylinders evenly raises the pouring vessel to accommodate the positioning of the mold adjacent the nozzle and evenly lowers the pouring vessel to position the nozzle flush with the mold.

20. The contact pouring vessel as defined in claim 19 wherein the elevating means further includes a plurality of vertical guide bars to prohibit horizontal movement of the pouring vessel as the plurality of hydraulic cylinders raises and lowers the pouring vessel, and the hydraulic system includes a proportional control valve to control the speed of the hydraulic cylinders, a plurality of flow dividers for evenly filling each hydraulic cylinder with fluid as the pouring vessel is raised and evenly evacuating each hydraulic cylinder with fluid as the pouring vessel is lowered, and a plurality of check valves to check the hydraulic cylinders when the pouring vessel is raised to hold the pouring vessel in a raised position.

21. A method of directly pouring molten metal into a mold, said method comprising the steps of:

providing a pouring vessel for holding the molten metal in a molten state;

providing a nozzle within the pouring vessel having an orifice through which the molten metal can flow;

elevating the pouring vessel to accommodate the positioning of the mold adjacent the nozzle;

positioning the mold under the nozzle of the pouring vessel;

lowering the pouring vessel to position the nozzle of the pouring vessel flush with the mold;

filling the mold with the molten metal through the orifice of the nozzle;

elevating the pouring vessel; and automatically cleaning the nozzle within the pouring vessel.

22. The method as defined in claim 21 wherein the step of cleaning the nozzle further includes the steps of:

rotating a cutter having teeth; and pivoting the rotating cutter adjacent the nozzle to clean a surface of the nozzle.

23. The method as defined in claim 21 wherein the step of cleaning the nozzle further includes the steps of:

rotating an abrasive grinding disk having a coarse surface; and pivoting the abrasive grinding disk adjacent the nozzle to clean a surface of the nozzle.

* * * * *